US008277138B2

(12) United States Patent
Wakalopulos

(10) Patent No.: US 8,277,138 B2
(45) Date of Patent: Oct. 2, 2012

(54) MACHINE AND METHOD FOR RAPID APPLICATION AND CURING OF THIN ULTRAVIOLET LIGHT CURABLE COATINGS

(75) Inventor: George Wakalopulos, Pacific Palisades, CA (US)

(73) Assignee: Adastra Technologies, Inc., Torrance, CA (US)

( * ) Notice: Subject to any disclaimer, the term of this patent is extended or adjusted under 35 U.S.C. 154(b) by 308 days.

(21) Appl. No.: 12/751,606

(22) Filed: Mar. 31, 2010

(65) Prior Publication Data

US 2010/0209621 A1 Aug. 19, 2010

Related U.S. Application Data

(63) Continuation-in-part of application No. 12/478,970, filed on Jun. 5, 2009, which is a continuation-in-part of application No. 12/209,080, filed on Sep. 11, 2008, now Pat. No. 7,731,379, and a continuation-in-part of application No. 12/112,753, filed on Apr. 30, 2008, now Pat. No. 7,775,690.

(51) Int. Cl.
*A46B 11/04* (2006.01)

(52) U.S. Cl. ..... 401/270; 401/268; 401/1; 401/2; 118/620; 118/642; 427/508; 427/553

(58) Field of Classification Search ..... 401/1, 2, 401/138, 139, 140, 268, 270, 282; 118/620, 118/641, 642, 643; 427/508, 553
See application file for complete search history.

(56) References Cited

U.S. PATENT DOCUMENTS

| | | | | |
|---|---|---|---|---|
| 4,975,300 | A | 12/1990 | Deviny | |
| 5,003,185 | A | 3/1991 | Burgio, Jr. | |
| 6,096,383 | A * | 8/2000 | Berg et al. | 427/493 |
| 6,361,194 | B1 | 3/2002 | Evans et al. | |
| 6,468,350 | B1 * | 10/2002 | Hillenbrand | 118/620 |
| 6,538,258 | B1 * | 3/2003 | Rau et al. | 250/504 R |
| 6,716,305 | B2 | 4/2004 | Green et al. | |
| 6,739,716 | B2 | 5/2004 | Richards | |
| 6,761,127 | B2 | 7/2004 | Field et al. | |
| 6,953,940 | B2 | 10/2005 | Leighley et al. | |
| 7,344,272 | B2 | 3/2008 | Cooper et al. | |
| 8,029,739 | B2 * | 10/2011 | Field et al. | 422/292 |
| 2009/0092764 | A1 | 4/2009 | Hoeckelman | |
| 2009/0301027 | A1 | 12/2009 | Pelletier et al. | |

* cited by examiner

*Primary Examiner* — David Walczak
(74) *Attorney, Agent, or Firm* — Schneck & Schneck; Thomas Schneck

(57) ABSTRACT

A moveable machine to rapidly apply and cure thin layers of a UV curable coating on a surface such as a floor. The machine has an applicator to apply a thin curable coating in a path following the direction of motion of the machine. The machine also has UV lamps to cure the curable coating with a curing beam that overlaps newly applied coating. The UV lamps emit an intense UV radiation beam creating an annular cure zone around the applicator path. Movement of the machine along with the ensuing movement of the applicator and rotating UV lamps causes the applied curable coating to be exposed to the annular cure zone and cured. This rapid curing of applicator coating paths allows the machine to be immediately passed over the cured area multiple times and rapidly build up multiple thin cured layers to achieve a thick coating.

10 Claims, 8 Drawing Sheets

MACHINE AND METHOD FOR RAPID APPLICATION AND CURING OF THIN ULTRAVIOLET LIGHT CURABLE COATINGS

CROSS-REFERENCE TO RELATED APPLICATIONS

This application is a continuation-in-part of application Ser. No. 12/478,970, filed Jun. 5, 2009, in turn a continuation-in-part of application Ser. No. 12/209,080, filed Sep. 11, 2008, which is now U.S. Pat. No. 7,731,379, and application Ser. No. 12/112,753, filed Apr. 30, 2008, which is now U.S. Pat. No. 7,775,690.

TECHNICAL FIELD

The present invention relates generally to the application and quick curing of ultraviolet (UV) curable coatings. More specifically, the invention relates to a machine and method to concurrently apply and cure thin layers of UV curable coatings onto floors.

BACKGROUND

The application of coatings to large surface areas such as floors has various problems and difficulties. Various UV cure coatings have been developed, such as paints and varnishes, some being protective and some being decorative, or both. The molecules in these UV cure coatings become cross linked when exposed to UV radiation forming a hard curable surface. Water borne UV cure coatings have been developed which have water-like viscosity and are easy to apply. Their drawback, however, requires the water to evaporate before final curing. This may take several hours and is problematic in cold climates. The application of water borne UV coatings and the time required for curing produces several problems. Application and curing are done in two separate and time consuming steps, usually taking many hours. The final finish may be marred. Dust may settle and become trapped in the coating. Bubbles may be introduced during application and become trapped in the coating. Curing may be uneven due to irregular exposure to UV radiation, such as parts of a floor which may or may not be exposed to sunlight from a window. Also, thickness of the coating is difficult to control both. Thick coatings which provide protection are difficult to cure properly.

Recent advancements have produced UV curable polymers without solvents or other volatile compounds which evaporate from the liquid. They have yielded numerous high quality coatings which are first applied and then cured with portable UV lamps. Although these solventless UV curable coatings offer instant cure, they are used on small substrates such as small samples of wood, tile, stone, etc. Widespread use of these coatings has been limited on large surfaces such as floors due to problematic application processes which produce blemishes and a flawed appearance. Problems, which are deleterious to the coating's appearance, include dust, bubbles, particulates, and cure lines due to shrinkage and high viscosity. In addition, pigments and shrinkage also limit the thickness of the coatings. This is especially important where thicker coatings are needed to provide adequate protection, especially to surfaces such as floors.

Both chemical and physical solutions to application problems with solventless UV coatings are being attempted. Feathering the edge of reflectors, dithering the light source, modifying the coatings characteristics, and using novel rollers or brushes, are being tried with some success. Yet even with these solutions, coatings which are thick enough to provide adequate protection when applied in the field to surfaces such as floors, suffer from systematic problems associated with their surface tension, viscosity, and surface characteristics. Pigmented coatings are particularly troublesome and require special lamps for deep cure, and also require precise thickness control as do clear or satin like coatings. In addition, as with water borne UV coatings, this is a separate, time consuming, two-step process of application and then cure.

High quality very thin instant UV curable coatings are now successfully applied in the field with squeegee and cloth applicators on smooth wood, marble, stone, etc. However, the painstaking and time consuming manual application processes and lack of longevity and durability for such very thin coatings on floors are impractical.

A better way is needed to reduce the application and curing time, eliminate the introduction of blemishes into the cured coating, and easily and rapidly build a coating to a desired thickness.

SUMMARY

The present invention achieves this better way with the combination of the application and curing functions into a single machine, which rapidly and concurrently applies and cures a thin layer of curable coating. By rapidly applying and curing a succession of thin coatings, a coating of standard thickness may be achieved faster than a single application of a standard thickness coating. For example, a standard thickness concrete coating may be four mils thick and usually takes 24 hours to cure. For a room size floor, multiple coatings thinner than one mil each may be applied and cured successively in a period of few minutes. The machine may be operated by one person to rapidly apply many thin layers to achieve a thick coating since additional layers may be applied immediately without waiting. This allows for rapid buildup to a thick layer of clear, satin, or pigmented coatings while eliminating the various problems of dust, bubbles, cure lines, shrinkage, extended time between application and cure, etc.

This is achieved by combining UV curing lamps and curable coating applicators in a single machine which cures the coating rapidly and immediately after its application, i.e., within a few minutes. Some embodiments are motorized and some are not. Some embodiments use rotating applicators and UV curing lamps, some embodiments use stationary applicators and UV curing lamps, and some use a combination of stationary and rotating applicators and UV curing lamps. The UV curing lamps emit UV radiation to create a curing zone around the applicators. The applicators and their immediately surrounding area are protected from the UV radiation using a combination of UV lamp design and UV radiation masks.

In one embodiment, the applicator applies a thin linear swath or path of curable coating, say less than one mil thick. Movement of the machine exposes the applied curable coating to an annular curing zone that overlaps the exposed path yielding a cured coating path on top of which additional coating may be immediately applied thereby building up a thick layer of coating, say several mils thick. Applicators may be in various shapes and configurations such as rotating or orbital pads, rollers, squeegees, spray nozzles, etc. In other embodiments, UV lamps may be stationary and circularly placed around the applicator, to one side of the applicator, in front and in back of the applicator, etc.

Various mechanisms are employed to regulate the flow of curable coating to the applicator, adjust the power of the UV lamps, the rotation of the applicator and UV lamps. All of these embodiments allow for rapid application and curing of thin layers which reduce time spent for application and cure, eliminate blemishes, and allow for a rapid buildup of a thick coating.

DETAILED DESCRIPTION

Figure 1:
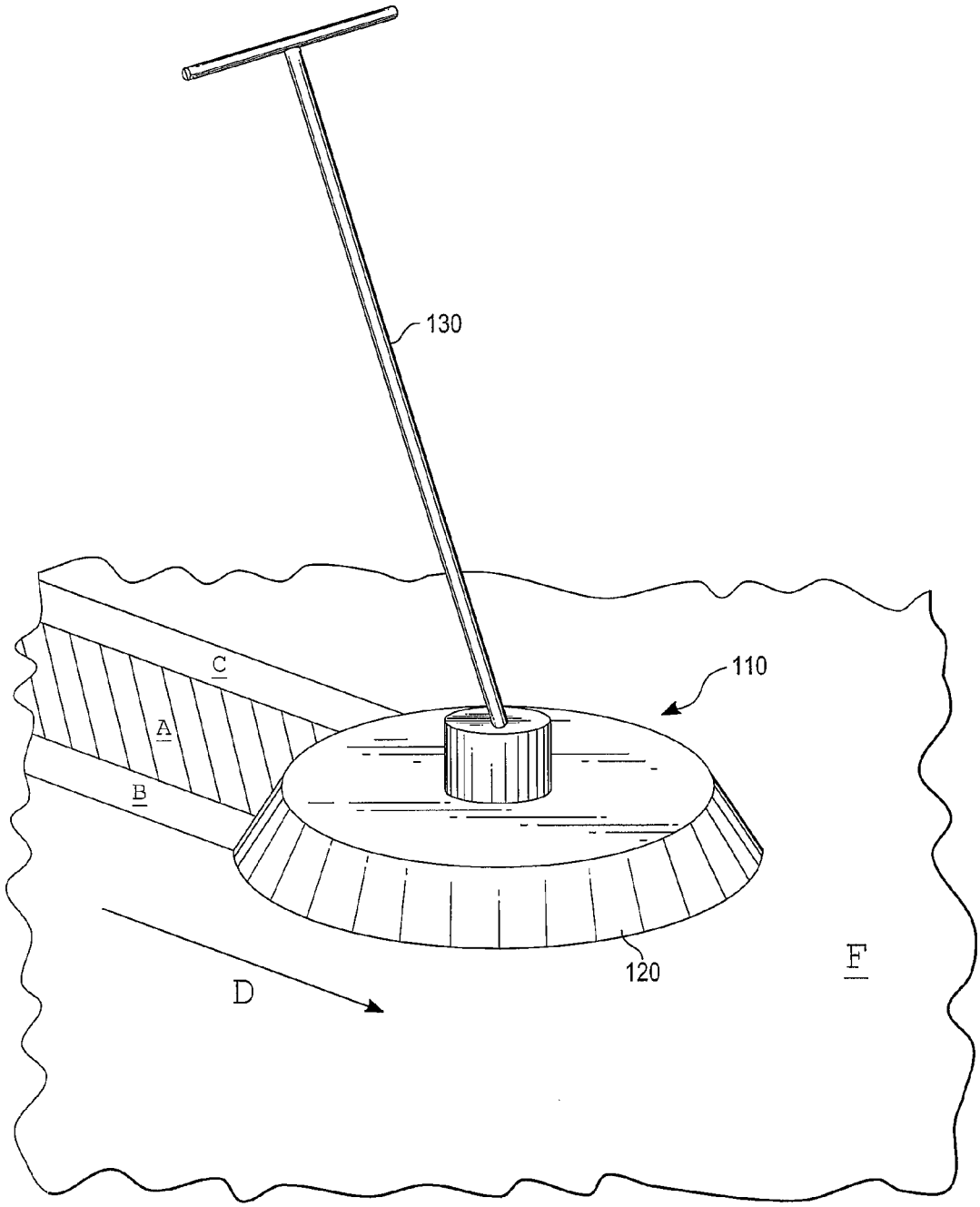
FIG. 1 is a perspective view of a machine for applying and curing a solventless UV coating on a floor in accordance with the present invention.

With reference to FIG. 1, a machine 110 with a rigid handle 130 and housing 120 applies and cures an ultraviolet (UV) curable coating on floor F, using an applicator and UV light source, both not shown in FIG. 1 but are seen and described below. Handle 130 may be used to move and guide the machine 110, for example in direction D indicated by an arrow, across floor F. Movement of the machine 110 in this embodiment is not limited to a straight linear motion. Machine 110 may move in straight lines, curves, circles, zigzags, etc. As machine 110 moves in direction D, coating is applied to floor F and cured leaving linear swath A of applied and cured coating behind machine 110. The width of path A is smaller than the diameter of housing 120 and smaller than the cure zone, which is the combined width of swaths A, B, and C. In this embodiment handle 130 is T-shaped, other embodiments may use differently shaped handles which are attached to the housing 120 in areas other than shown in FIG. 1. Although the shape of housing 120 is circular, other embodiments may employ different shapes, for example, a square, a rectangle, etc.

Figure 2:
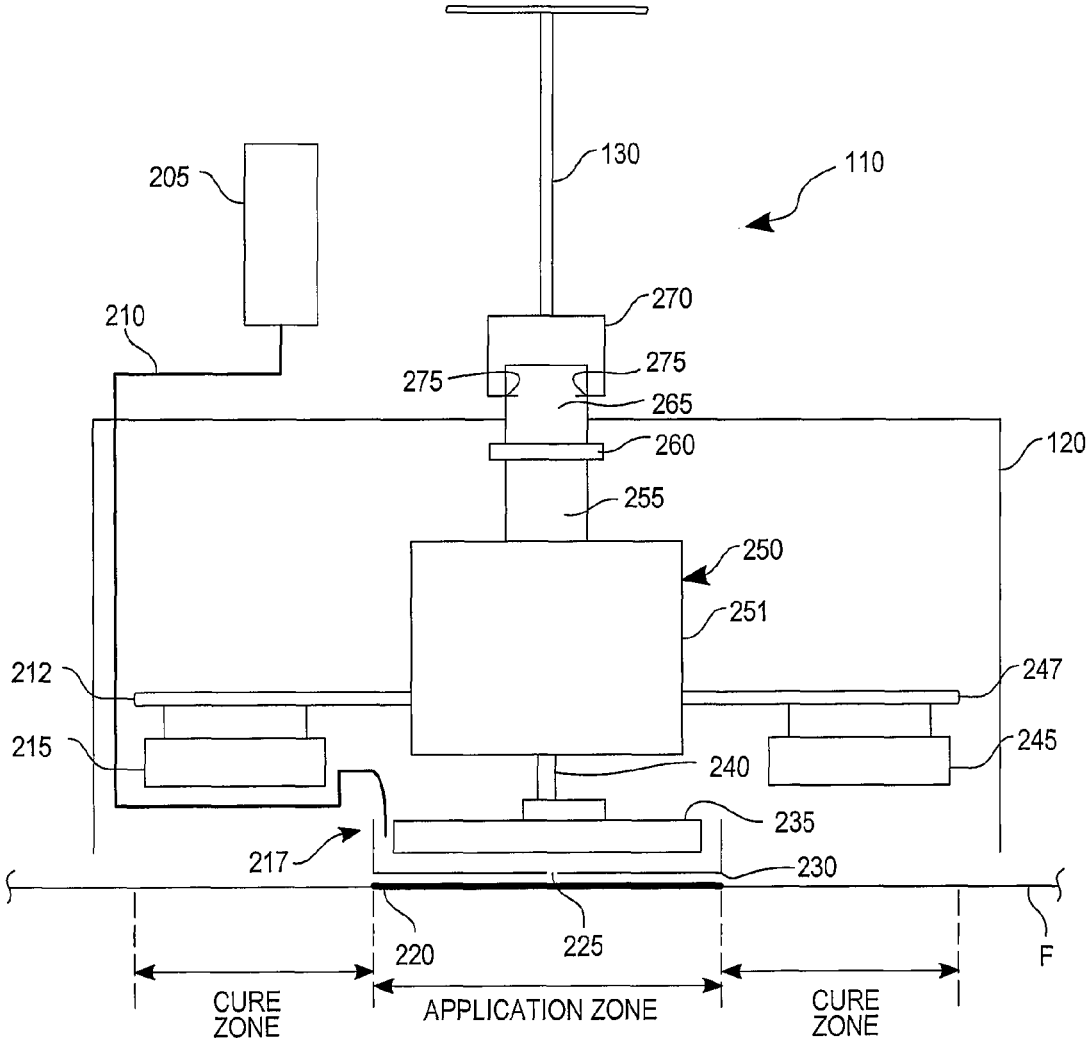
FIG. 2 is a two dimensional cross sectional view of an embodiment of the machine of FIG. 1 where UV lamps and a coating applicator pad move in circular motion.

In FIG. 2, mechanisms for an embodiment of machine 110 are disclosed. Handle 130 is fixedly attached to handle attachment yoke 270 which is pivotally attached to motor support 265 via two pivot mechanisms 275. Motor support 265 is fixedly attached to housing 120. This allows handle 130 to be pivoted up and down from pivot mechanisms 275 and be able to move and guide machine 110.

Motor support 265 is attached to rotating slip ring 260. Rotating slip ring 260 is part of rotating motor extension 255 which is fixedly attached to the outer casing of motor 250. Slip ring 260 is an electro mechanical bearing that conducts electricity to motor 250 allowing motor 250 to rotate independently of housing 120. An electric cable, not shown, is used to provide electric power which is transferred through slip ring 260 to motor 250.

Motor 250 has an outer casing 251 that rotates lamp arms 212 and 247 at a slow rate, say 60 rpm. Lamp arms 212 and 247 are attached to lamp housings 215 and 245. Lamp housings 215 and 245 each contain at least one high-intensity linear UV lamp, not shown. The UV lamps are tubes that are of sufficient power and design to cure a UV curable coating almost instantly. Preferred UV lamps are mercury vapor tubes, such as commercial street lamp tubes, which contain high temperature ionized gas vapor. Such power, for example one hundred watts per centimeter, is needed to quickly cure UV curable coatings. An alternative UV lamp consists of an array of closely spaced LED (light emitting diode) sources emitting UV over a narrow wavelength range. In this embodiment both the UV lamp housings 215 and 245 and their contained UV lamps extend radially from motor 250. In other embodiments the contained UV lamps may be in other than radial configurations from the motor. There is a power adjustment device, not shown, to control the power of the UV lamps allowing for varying levels of cure, for example, partial or complete cures. UV lamp housings 215 and 245 contain parabolic cross-section reflectors to direct emitted UV radiation to a suitable cure zone only a few centimeters away wherein the curable coating is cured. In alternate embodiments there may be more than two lamp arms and lamps. In an alternate embodiment, motor 250 does not rotate lamp arms. In this embodiment a sufficient number of lamp housings are employed around the circumference of the dispensing system 217 to produce a toroidal curing zone. UV lamps and other housings used for curing UV curable coatings are the subject of prior application Ser. No. 12/478,970. The toroidal curing zone overlaps and cures newly applied swath of dispensed coating.

Shaft 240 rotates faster than the outer casing of the motor and is attached to dispensing system 217 which includes an off center orbital mechanism 235, dispensing chamber 230 with its dispensing orifice 225, and dispensing pad 220. In alternate embodiments off center orbital mechanism 235 may have other configurations such as centered rotary motion, centered orbital motion, etc. Dispensing pad 220 rests on floor F. Curable coating is provided to dispensing system 217 from container 205 through tube 210. Container 205 may be mounted on housing 120, stored inside housing 120 with an access port, or any other suitable manner to deliver curable coating to dispensing system 217.

Container 205 has a flow control mechanism, not shown, which regulates and may also stop delivery of curable coating to dispensing system 217. In one embodiment, curable coating may be poured into container 205 and the flow control mechanism is used to regulate delivery of curable coating. In other embodiments curable coating may be stored in a plastic container or bag. To prevent curing of the coating while still in the container or bag, the container or bag is composed of a UV blocking material or coated with a UV blocking coating. The plastic container or bag may be placed into the container 205 and pierced by a piercing mechanism, not shown, thus filling the container with curable coating. Delivery to the dispensing system for this embodiment is regulated by the flow control mechanism of the container 205, not shown. In another embodiment, the plastic container or bag may be similar to an intravenous (IV) delivery system used by medical personnel. In this embodiment the curable coating is stored in a bag similar to an IV bag which has its own flow control mechanism and self resealable orifice. The bag may be detachably incorporated into container 205 or be detachably connected to tube 210 via the self resealable orifice. Delivery of curable coating is controlled by the flow control mechanism of the bag. In addition, the bag may be detached and resealed thereby storing unused curable coating. Of course all components of the bag are UV blocked as described above. Printed material may be applied to the container or bag. This printed material may be information regarding the curable coating such as, manufacturer, name and type of curable coating, instructions for use of the curable coating, etc.

Briefly, in operation, curable coating in container 205 flows through tube 210 to dispensing system 217 and is applied to a surface, such as a floor, while the motor 250 rotates lamp arms 212 and 247 and shaft 240. Flow of curable coating from container 205 is regulated by flow control mechanisms, not shown, to control the thickness of curable coating applied to a surface. Rotation of lamp arms 212 and 257 and dispensing system 217 done by motor 250 and is controlled by the gearing control mechanisms of motor 250. The outer casing of motor 250 directly rotates lamp arms 212, 247 at a slower speed while shaft 240 rotates off center orbital mechanism 235 which in turn rotates dispensing system 217 in an off center orbital manner at a higher speed. Gears or a clutch can control the different speeds of rotation.

The controlled flow of curable coating from the container 205 via tube 210 enters the rotating dispensing chamber 230 and passes through dispensing orifice 225 to the center of dispensing pad 220. Dispensing pad 220 is in direct contact with the floor F of FIG. 1 and the curable coating is applied directly to the floor F from the rotating dispensing pad 220.

While curable coating is applied to the floor F from the dispensing pad 220, UV lamps contained in rotating UV lamp housings 215 and 245 emit high-intensity UV radiation creating an annular shaped cure zone encircling dispensing system 217. Radiation output power is several hundred watts per centimeter at the floor. The reflecting and shielding surfaces of UV lamp housings 215 and 245 are configured to form a high-intensity beam and to prevent UV radiation from contacting a circular area slightly larger in diameter than dispensing system 217 and concentric with dispensing system 217. In addition, dispensing system 217 may be configured with an optical mask surface situated between motor 250 and off center orbital mechanism 235. The optical mask surface is composed of UV blocking material or has a UV blocking coating to block UV radiation. This prevents the irradiation of dispensing system 217 and concomitant curing of the curable coating while still in the dispensing system 217 and very near it, i.e., before application to surface F.

Thickness of the curable coating applied to the floor F is controlled by flow control mechanisms of the container 205 and also by the speed with which the machine 110 is moved over the floor F. Thin coats, i.e., less than one mil, are achieved with a relatively quick flow of curable cure from the container 205 and relatively rapid movement of the machine 110 over the floor F. Thicker coats, although not preferred, are achieved with relatively slow flow of curable cure and relatively slow movement of the machine 110.

The dispensing pad 220 applies curable cure to the floor F. When the machine 110 is moved the applied curable coating is exposed to the annular shaped cure zone which also moves with the machine. Since the cure zone encircles the dispensing system 217 applied curable coating is, exposed and instantly cured irrespective of the direction with which the machine 110 is moved on floor F. The annular cure zone intersects the linear path of dispensed coating. The degree of cure, partial or complete, is controlled by the power adjustment device connected to the UV lamps. When a complete cure is done, the curable coating may need to contain adhesion promoters or other chemical means to ensure proper adhesion of an additional layer of curable coating. Since the coating is cured concurrently with its application on the floor F, additional coats may be applied and cured immediately thus creating a thick coat by rapidly applying multiple thin coats. Rapid curing of thin coats while protected from the surrounding environment by housing 120 avoids the problems mentioned above of such as dust, bubbles, shrinkage, uneven curing due to uneven UV radiation from windows etc., time lost waiting for a coat to dry, etc.

Figure 3:
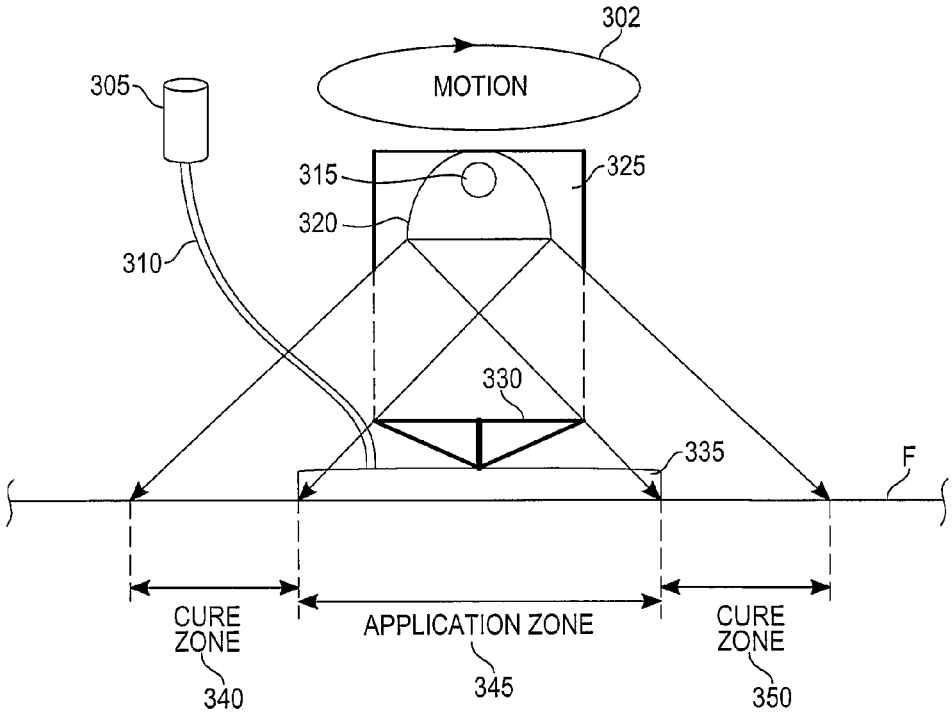
FIG. 3 is a two dimensional cross sectional view of an embodiment of the machine of FIG. 1 with a rotating UV lamp and a rotating coating applicator pad.

With reference to FIG. 3 a single elongated lamp housing 325 is used with dispensing pad 335. The separation of the lamp housing from floor F is only a few centimeters. Curable coating is stored in container 305 and is applied to dispensing pad 335 via tube 310. Container 305 operates as described above for container 205 of FIG. 2 with the same controls and embodiments. The lamp housing 325 contains an elongated high-intensity UV lamp 315 and elongated reflector 320. Lamp housing 325 has a power adjustment device for UV lamp 315 as described above for FIG. 2. The reflector 320 has a parabolic shape which reflects UV radiation to cure zones 340 and 350 which are parallel to lamp housing 325 and non-overlapping with dispensing pad 335 and application zone 345. There is also a UV radiation mask 330. All of these components rotate in a circular motion as indicated by motion arrow 302.

Operation is similar to that described for FIG. 2 where the main difference is lamp housing 325. Lamp housing 325 is centrally located above dispensing pad 335 and along a diameter concentric to dispensing pad 335. Reflector 320 has parabolic cross-section and primarily reflects UV radiation emitted from UV lamp 315 in a beam to cure zones 340 and 350. Mask 330 is composed of UV blocking material or layered with a UV blocking coating, and protects application pad 335 and application zone 345 from UV radiation. This masking and reflection prevents curing of the curable coating while still on dispensing pad 335 and while being applied in application zone 345 as described above for FIG. 2. The dispensing pad 335 and lamp housing 325 are rotated by a motor, not shown, similar to that in FIG. 2. Dispensing pad 335 may rotate in any of the rotational embodiments described above for FIG. 2. When the lamp housing is rotated it creates a toroidal shaped cure zone encircling dispensing pad 335 and application zone 345 as also described above for FIG. 2. Additional applications of thin layers of curable coating to floor F of FIG. 1 proceed as described above for FIG. 2.

Figure 4:
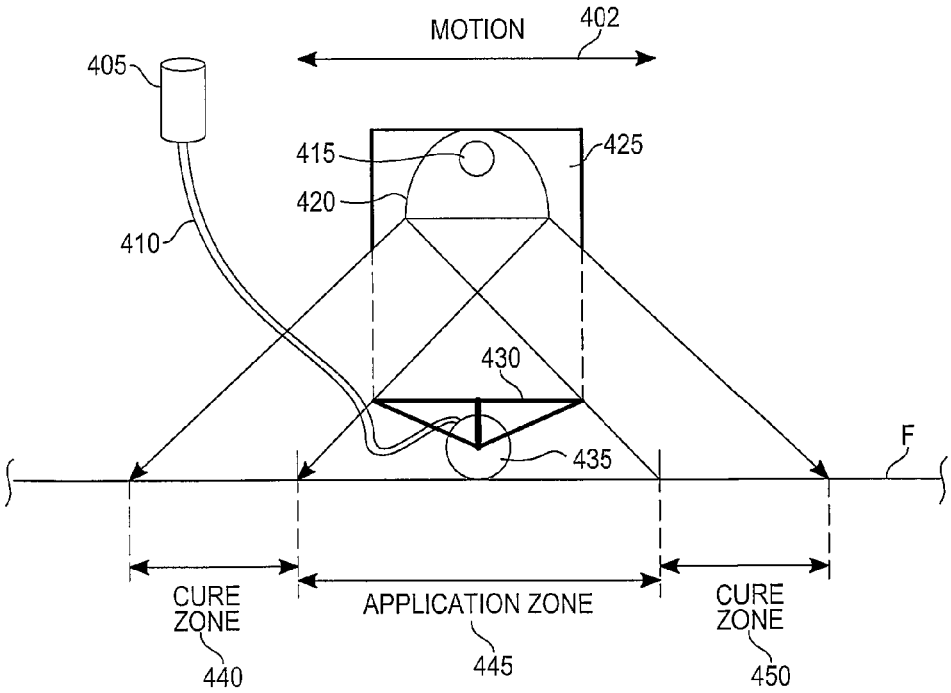
FIG. 4 is a two dimensional cross sectional view of an embodiment of the machine of FIG. 1 with a stationary UV lamp and a roller applicator.

With reference to FIG. 4 a single lamp housing 425 is used with a dispensing roller 435. Curable coating is stored in container 405 and is applied to dispensing roller 435 via tube 410. The separation of lamp housing 425 from floor F is only a few centimeters. Container 405 operates as described above for container 205 of FIG. 2 with the same controls and embodiments. The lamp housing 425 contains an elongated high-intensity UV lamp 415 and elongated reflector 420. Lamp housing 425 has a power adjustment device for UV lamp 415 as described above for FIG. 2 with the same beam intensity, more or less. The reflector 420 has a parabolic shape which reflects UV radiation to cure zones 440 and 450 which are parallel to lamp housing 425 and non-overlapping with dispensing roller 435 and application zone 445. There is also a UV radiation mask 430. These components do not rotate.

Operation is done with a linear motion as depicted by linear motion arrow 402. The lamp housing 425 and its components are similar to those of FIG. 3 except they do not rotate. Lamp housing 425 is centrally located above dispensing roller 435 and parallel to it. Reflector 420 primarily reflects UV radiation emitted from UV lamp 415 to cure zones 440 and 450.

Mask 430 is composed of UV blocking material or layered with a UV blocking coating, and protects dispensing roller 435 and application zone 445 from UV radiation. This masking and reflection prevents curing of the curable coating while still on dispensing roller 435 and while being applied in application zone 445 as described above for FIGS. 2 and 3. The dispensing roller 435, which is perpendicular to motion arrow 402, spins to allow back and forth motion as indicated by motion arrow 402. The curing zones 440 and 450 are in front of and behind the application zone 445. When the embodiment of FIG. 4 is moved, dispensing roller 435 deposits a layer curable coating. The cure zones 440 and 450 also move accordingly, exposing the newly deposited layer of curable coating to UV radiation thereby curing it. Additional applications of thin layers of curable coating to floor F of FIG. 1 may proceed as described above for FIG. 2.

Additional arrangements of applicators and UV lamps are disclosed in FIGS. 5-8. Flow control mechanisms, power adjustment devices, reflecting and shield surfaces, UV masks, etc. are used, as discussed above, but only the motion and arrangements of the applicators and UV lamps are discussed.

Figure 5:
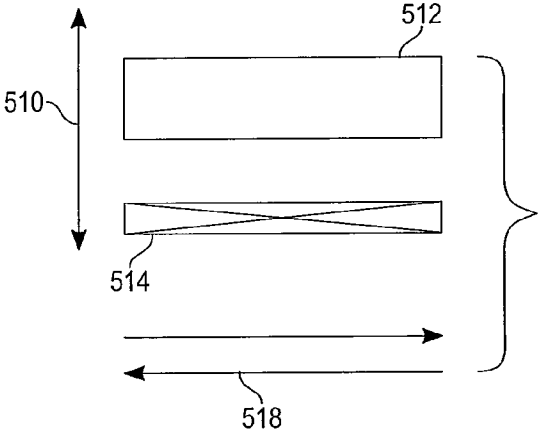

With reference to FIG. 5 a rectangular applicator 512 such as a roller, squeegee, a series of spray nozzles, etc. is used to apply a thin layer of curable coating. A rectangular UV light source 514 is positioned parallel to and to one side of applicator 512 creating a cure zone parallel to and to one side of applicator 512. Applicator 512 and UV light source 514 are moved together back and forth together as a unit over floor F of FIG. 1 in directions indicated by movement arrow 510. In addition, UV light source 514 may oscillate parallel to applicator 512 and perpendicular to motion arrow 510 as indicated by motion arrows 518 creating a cure zone that is wider than applicator 512.

Figure 6:
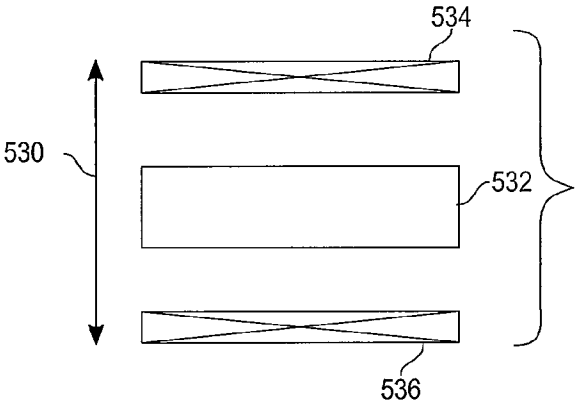
FIGS. 5, 6, 7, and 8 are two dimensional top plan views of alternate arrangements of UV lamps and coating applicators.

With reference to FIG. 6 a rectangular applicator 532 such as a roller, squeegee, series of spray nozzles, etc is used to apply a thin layer of curable coating. Two rectangular UV light sources 534 and 536 are positioned parallel to applicator 532 where one of the UV light sources is in front of applicator 532 and the other is behind applicator 532. This arrangement creates two cure zones, one in front of applicator 532 and another behind applicator 532. Applicator 532 and UV light sources 534 and 536 are moved back and forth together as a unit over floor F of FIG. 1 in directions indicated by movement arrow 530. UV light sources 534 and 536 may be stationary or may oscillate, parallel to applicator 532, as described for FIGS. 5A and 5B.

Figure 7:
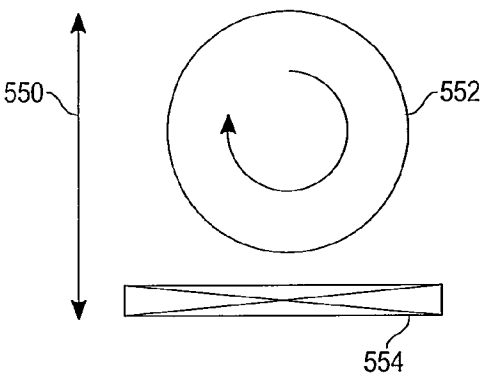

With reference to FIG. 7 a rotating applicator 552 is used to apply a thin layer of curable coating. A rectangular UV light source 554 is positioned parallel to and to one side of applicator 552 creating a cure zone parallel to and to one side of applicator 552. Applicator 552 and UV light source 554 are moved together back and forth together as a unit over floor F of FIG. 1 in directions indicated by movement arrow 550. UV light source 554 may be stationary or oscillate perpendicular to movement arrow 550 as described for FIG. 5.

Figure 8:
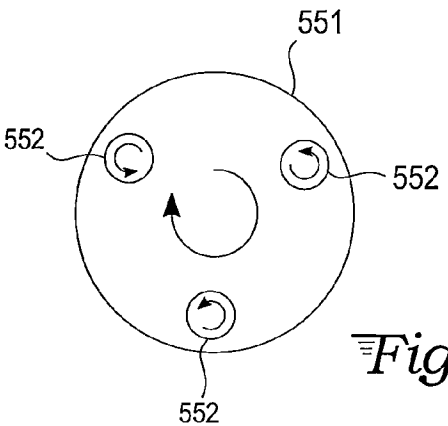

With reference to FIG. 8 a rotating dispensing system 551 contains three rotating application pads 552. Other embodiments may have more or fewer application pads. Rotating dispensing system 551 may have an off center orbital mechanism or any of the other orbiting mechanisms discussed above for FIG. 2. In this embodiment rotating dispensing system rotates in a clockwise manner but in other embodiments may rotate counter clockwise. Rotating application pads 552 rotate counter to rotating dispensing system 551 which in this particular embodiment is counter clockwise rotation. UV lamps, not shown, may be any of the configurations discussed above for rotating dispensing systems and dispensing pads.

In other embodiments, motion of the machine 110 of FIG. 1 across floor F may be accomplished mechanically. Motor 250 of FIG. 2 may be connected to wheels thereby imparting motion to machine 110. There may be an additional motor connected to wheels thereby imparting motion to machine 110. This mechanized motion may have controls on the machine, for example, on the handle 130, or may even be controlled remotely obviating the need for handle 130.

Figure 9:
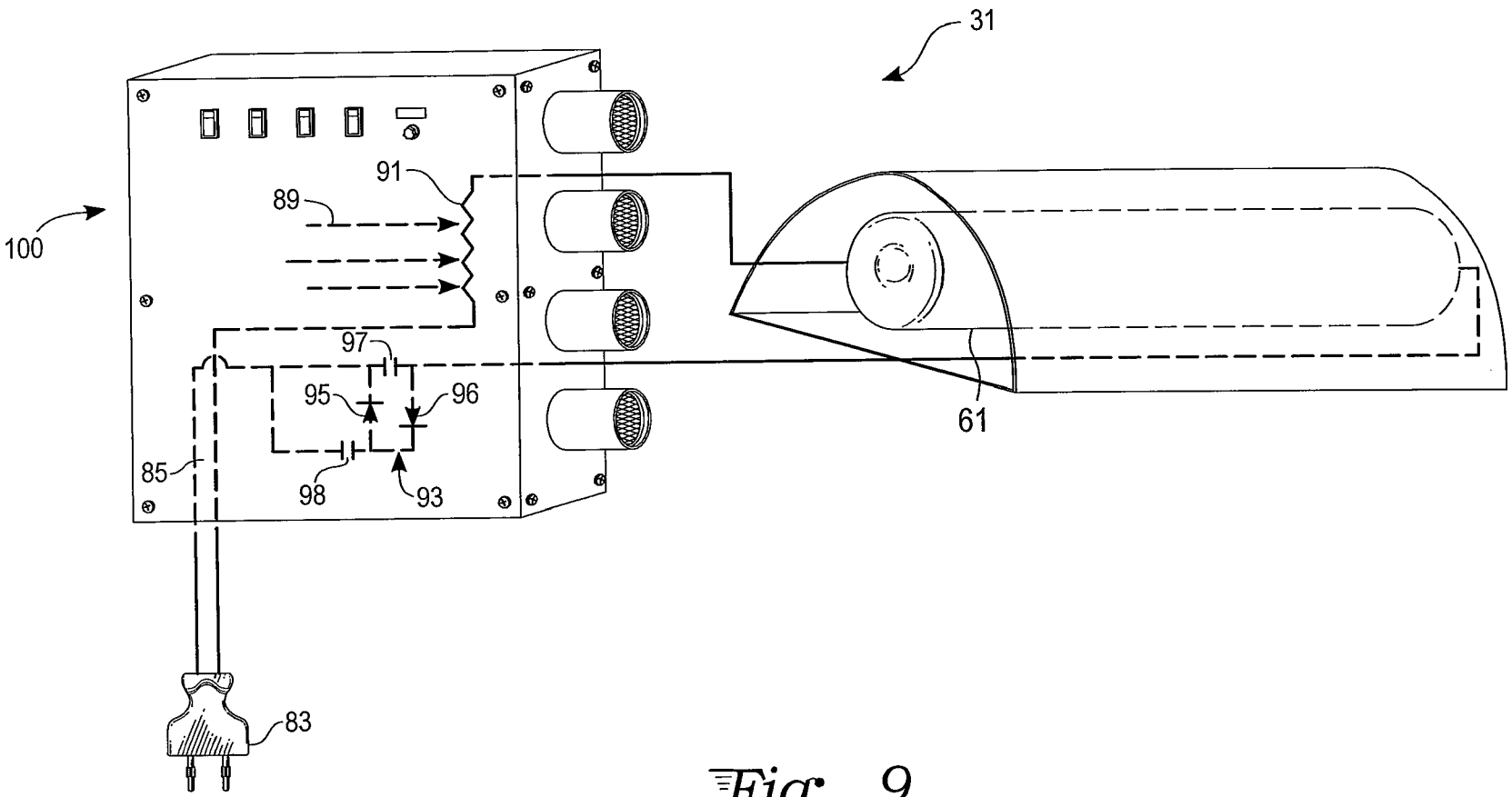
FIG. 9 is an electric plan for the beam forming structure of FIGS. 6 and 7.

FIG. 9 shows electric relationship of air flow and UV lamps. A variable ballast resistor 91 is mounted inside a portable box 100 for mercury vapor lamp tubes. Ballast resistor 91 is typically a nichrome wire and has an electric connection to an AC plug 83 that has a pair of wires 85 which also connect UV lamp 61 within UV lamp housing 31. The nichrome wire forming ballast resistor 91 is of the type commonly found in hair dryers and toasters and is used to offset the negative impedance or resistance of an associated UV lamp. Air flow 89 indicated by arrows, is created by a blower that cools and stabilizes the ballast resistor 91. If LEDs are used as UV lamps, a LED array has a ballast consisting of an appropriate voltage and current supply. A ballast fan is not usually required.

Diodes 95 and 96 are oppositely biased at opposite plates of a first capacitor 97 while a second capacitor 98 forms a quasi-bridge circuit for voltage multiplication forming high voltage multiplier circuit 93. Circuit 93 is mounted inside the box 100. The circuit draws little current but high voltage from the circuit allows ignition of lamp material such as molten mercury within a well of the UV lamp 61 thereby forming an ionic plasma in UV lamp 61. The variable ballast resistor 91 is used to counteract the negative resistance created by the mercury vapor in UV lamp 61. The ballast resistor 91 prevents the UV lamp 61 from drawing excessive current and provides electric stability as the lamp warms. As the UV lamp 61 continues to heat up during operation, internal gas pressure within the UV lamp 61 tube causes a higher voltage to be required to maintain the arc discharge. The higher voltage is not available through the circuit. Since the voltage necessary to maintain the arc exceeds the voltage provided by the electric ballast, the arc fails. The UV lamp 61 momentarily goes out and begins to cool down. As gas pressure in the UV lamp 61 goes down, liquid mercury will form and the high voltage multiplier circuit 93 can be used to ignite the arc and send current into ballast resistor 91. The hot arc heats the UV lamp 61 causing the UV lamp 61 to glow and produce UV light once again. This on-off cycle is inherent in the performance of the UV lamp 61 and allows relatively high intermittent power to be obtained from a simple circuit.

Figure 10:
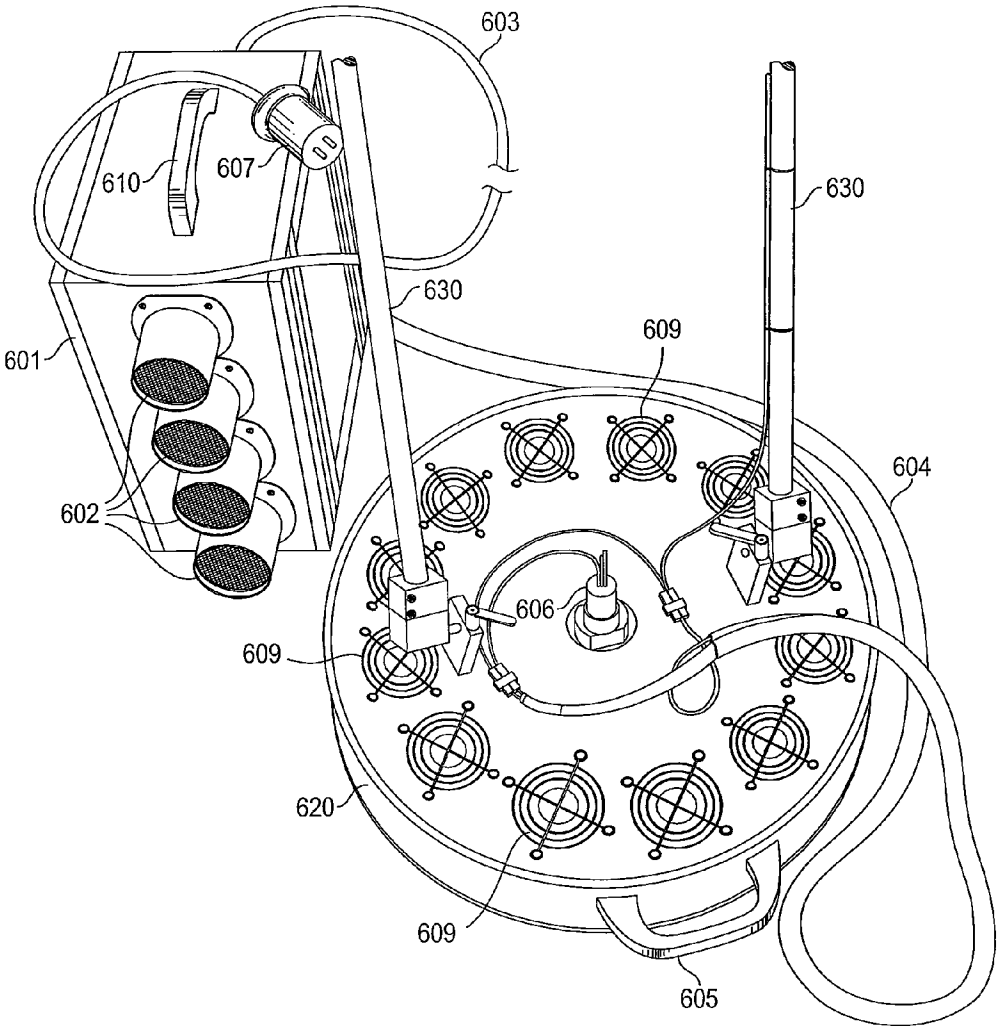
FIG. 10 is a top perspective view of a machine for curing a UV curable coating on a floor in accordance with the present invention.

With reference to FIG. 10, a housing 620 and electric ballast system 601 are shown. Housing 620 and electric ballast system 601, which enable the curing of UV curable coatings, are an alternate embodiment of previously discussed housing 120 of FIG. 1 which enables concurrent application and curing of thin layers of UV curable coatings. This specific embodiment of housing 620 does not dispense UV curable coating and does not contain components for dispensing UV curable coatings such as the FIG. 2 dispensing system 217 with its various parts as described above, container 217, and tube 210. Alternate embodiments may include the FIG. 2 dispensing system 217 with its various parts as described above, container 217, and tube 210.

Lower members 630 of a rigid inverted U-shaped handle are shown attached to the top of housing 620. The lower members 630 are rigid and although shown as elongated members with a round cross section similar to a pipe, the cross section may be, although not limited to, shapes such as square, oval, and octagonal. The U-shaped handle may be used to guide and move the housing 620 on a surface, such as floor F of FIG. 1, in a similar manner to that described above for the T-shaped handle 130 of FIG. 1. Housing handle 605 positioned on the side of housing 620 may also be used to guide and move the housing 620 on a surface. Housing exhaust fans 609 are positioned on the top of housing 620 in an annular pattern near the perimeter of housing 620 such that housing exhaust fans 609 enable movement of air from inside housing 620, through the top of housing 620 to the ambient air above housing 620. The quantity and positioning of housing fans 609 may be varied. Motor support 606 is shown perpendicular to and extending above the middle of housing 620. Motor support 606 functions in a similar manner as described above for motor support 265 of FIG. 2.

Electric ballast system 601 is shown as a rectangular parallelepiped or box. Alternate embodiments may employ other shapes for electric ballast system, including but not limited to squares and cylinders. Electric ballast system 601 has ballast handle 610, ballast exhaust fans 609, electric power cord 603, electric power distribution cable 604, at least one variable resistance electric ballast, and a controller. Electric ballast system 601 is at least partially open enabling intake of air to ballast exhaust fans 609. Electric plug 607 is attached to electric power cord 603 opposite the attachment point of electric power cord 603 to electric ballast system 601. Electric plug 607 and electric power cord 603 enable supply of electric power to electric ballast system 601 when electric plug 607 is connected to a source of electric power. Electric power cord 603 is of sufficient length to facilitate operation of this embodiment which is discussed later.

The at least one variable resistance electric ballast resistor is mounted inside the ballast box 601 and is made of nichrome wire of the type commonly found in hair dryers and toasters. There is one variable resistance electric ballast for each UV lamp in housing 620 (UV lamps are not shown and discussed below). The ballast resistor offsets negative resistance of the lamp. Ballast exhaust fans 609 are shown positioned on a side of electric ballast system 601. The quantity of ballast exhaust fans 609 may be more or fewer than the four shown in FIG. 12. When in operation, ballast exhaust fans 609 vent hot air from the inside of electric ballast system 601 which is generated by operation of the at least one variable resistance electric ballast. This venting of the hot air helps to prevent the at least one variable resistance electric ballast from overheating. Electric power distribution cable 604 enables distribution of electric power from electric ballast system 601 to the various components of housing 620 and also provides ballast circuits connecting a variable resistance electric ballast to its corresponding UV lamp.

Electric power distribution cable 604 is of sufficient length to facilitate operation of this embodiment which is discussed later. The controller, mounted inside the electric ballast system, enables control of functions such as, but not limited to, the start and shut off sequence of the UV lamps and monitoring of electric power consumption.

Figure 11:
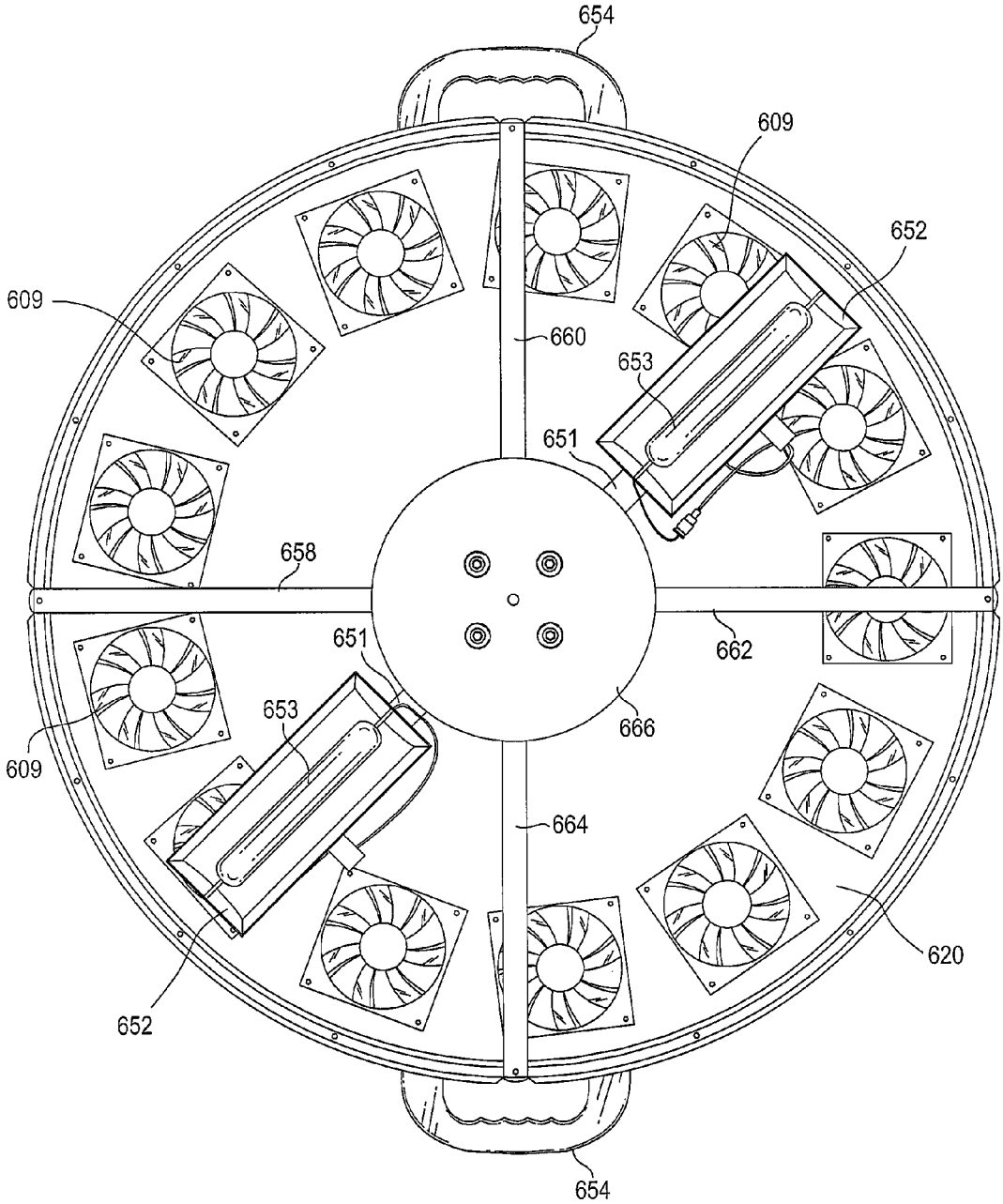
FIG. 11 is a bottom view of the interior of the machine of FIG. 12.

With reference to FIG. 11, components are shown from the underside of housing 620. Shown are, handles 654, housing exhaust fans 609, lamp arms 651, lamp housings 652, UV lamps 653, hub supports 658, 660, 662, 664, and hub 666. Several components of FIG. 2, although not shown, are used in this specific embodiment. These components of FIG. 2 are motor support 265, rotating slip ring 260, rotating motor extension 255, and motor 250. These components and their operation, to which reference is made for this specific embodiment, are fully described above.

The handles 654 are positioned on the side of housing 620 in a manner similar to housing handle 605 of FIG. 10. Housing exhaust fans 609, seen from their underside, have been described above in reference to FIG. 10. Components of FIG. 2, motor support 265, rotating slip ring 260, rotating motor extension 255, and motor 250 are incorporated into and function in housing 620 in the same manner in which they are incorporated into and function in housing 120 of FIG. 2. Lamp arms 651 are attached to the outer casing of motor 250 and rotated as described in reference to FIG. 2. Lamp arms 651 are connected to lamp housings 652 in a similar manner discussed above with reference to FIG. 2. Lamp housings 652 contain UV lamps 653. UV lamps 653 are of the same type discussed above with reference to FIG. 2. The quantity and positioning of lamp arms 651, lamp housings 652, and UV lamps 653 may all be varied as described above with reference to FIG. 2. UV lamps 653 are each connected to their corresponding variable resistance electric ballast of electric ballast system 601 via ballast circuits in electric power distribution cable 604.

Lamp housings 652 are parabolic in cross-section and constructed of sheet metal or plastic having reflective surfaces thereby enabling reflection of UV light emanating from UV lamps 653 as a downwardly directed beam. Lamp housings 652 are elongated structures with an internal parabolic cross-sectional shape whose axial focus is aligned with the axis of the elongated parabolic structure thereby enabling UV light generated by the UV lamps 653 to emerge as a linear beam directed onto a coating to be cured. In an alternate embodiment, the rotational speed of motor 250 may of a speed appropriate for rotating lamp arms 651. In this alternate embodiment, lamp arms 651 may be directly attached to the rotor of motor 250. Electric power is received via the electric power distribution cable 604 to operate components requiring electric power such as UV lamps 653, housing exhaust fans 609, motor 250, etc.

Hub 666 is connected to housing 620 by hub supports 658, 660, 662, 664. Hub 666 which may be constructed of materials such as sheet metal, plastic, etc. provides additional support for motor 250. Hub supports 658, 660, 662, 664 provide support for hub 666 and may be of solid or hollow construction. Solid construction may be bars of metal, plastic, or any material of sufficient strength to provide support for hub 666. Hollow construction may be in the form of tubes of metal, plastic, or any material of sufficient strength to provide support for hub 666. The cross section of solid or hollow struts may be rectangular, square, round, oval, etc. The bottom of housing 620 with hub 666 and hub supports 658, 660, 662, 664 is at least partially open enabling transmission of UV light to floor F of FIG. 1 and entry of ambient air for venting of hot air, accumulating inside housing 620, by housing exhaust fans 609.

Figure 12:
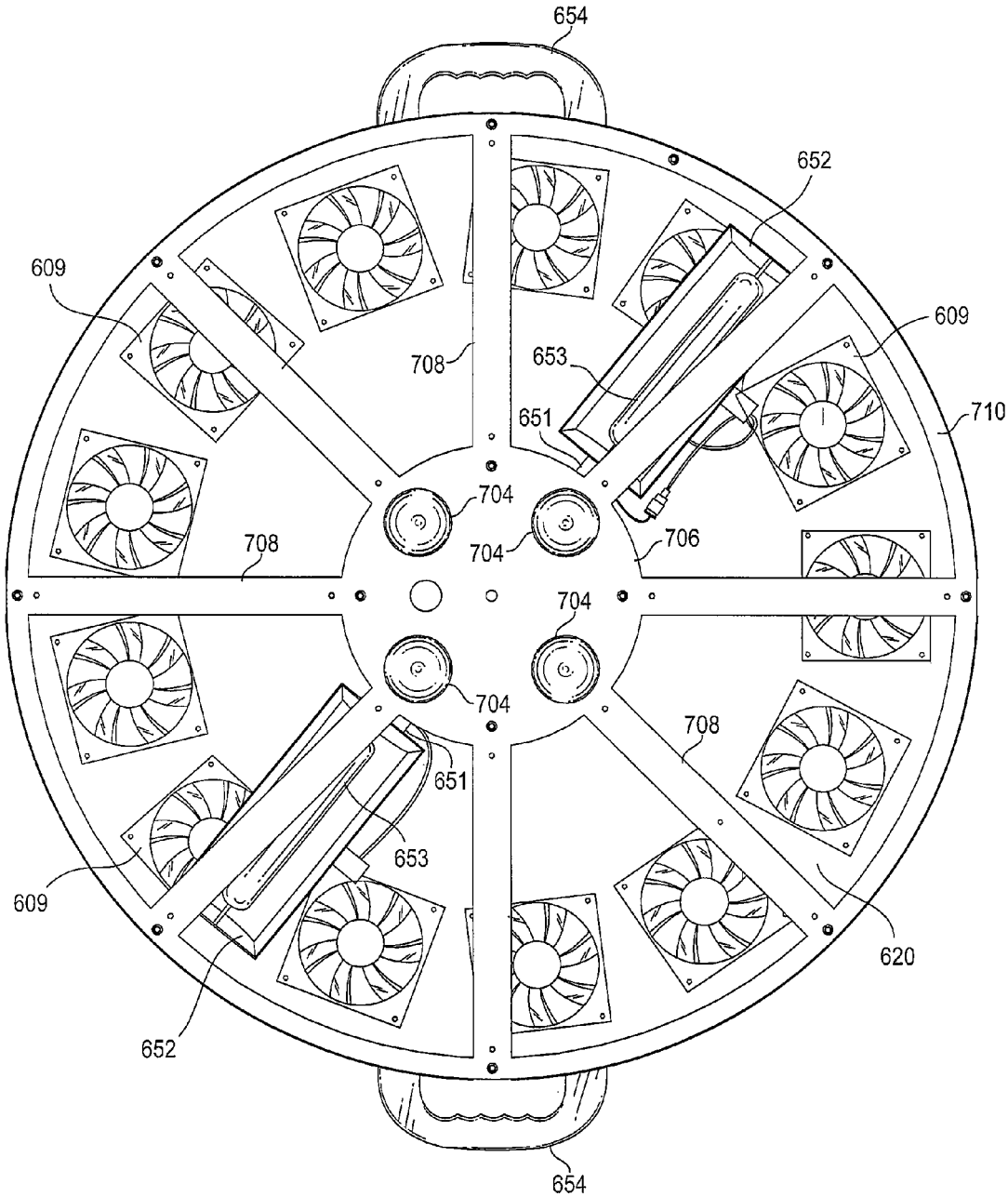
FIG. 12 is a bottom view of the interior of the machine of FIG. 12 with rollers.

Referring to FIG. 12, housing 620, handles 654, housing exhaust fans 609, lamp arms 651, lamp housings 652, UV lamps 653, rollers 704, and a support structure made up of central section 706, struts 708, and outer rim 710 are shown. Housing 620, handles 654, housing exhaust fans 609, lamp arms 651, lamp housings 652, and UV lamps 653 have been discussed above. The central section 706 is attached to the outer rim 710, which is annularly shaped and concentric with the central section 706, by struts 708 which extend radially from the central section 706 to the outer rim 710. The quantity of struts 708 may be more or fewer than the eight shown in FIG. 14. The support structure may be formed or stamped from a single sheet of metal thereby obviating the necessity of joining central section 706, struts 708, and outer rim 710 to form the support structure. In an alternate embodiment, central section 706, struts 708, and outer rim 710 may be individual parts that are joined together to form the support structure. The support structure is at least partially enabling transmission of UV light to floor F of FIG. 1 and entry of ambient air for venting of hot air, accumulating inside housing 620, by housing exhaust fans 609.

The central section 706 is attached to hub 666 of FIG. 11 and the outer rim 710 is attached to the bottom edge of housing 620. Rollers 704 are attached to the central section 706 providing additional support to hub 666, motor 205, and housing 620. Rollers 704 protrude from central section 706 thereby elevating the support structure and housing 620 from the floor F, enabling the housing to roll along floor F and allow entry of ambient air for venting of hot air, accumulating inside housing 620, by housing exhaust fans 609. Rollers 704 are preferably made from a non-marring material.

In operation, the UV lamps 653 rotate forming a toroidal curing zone as described above with reference to FIG. 2. As the housing 620 is rolled across floor F, uncured UV curable coating is cured when exposed to the curing zone. Since the curing zone surrounds the rollers 704, an area of coating is cured before the rollers 704 come in contact with the area thus preventing the rollers from contacting uncured coating. Electric ballast system 601 is placed on a cured portion of floor F near an uncured portion of floor F. Electric power distribution cable 604, which connects electric ballast system 601 and housing 620, is of sufficient length to allow rolling of housing 620 over the uncured portion of floor F without requiring undue repositioning of electric ballast system 601. To cure an additional uncured portion of floor F, electric ballast system 601 may be lifted using ballast handle 610 and carried to a position near the additional uncured portion of floor F while the housing 620 is rolled to the additional uncured portion of floor F. The housing 620 is rolled over the additional uncured portion of floor F thereby curing the uncured coating. Additional portions of uncured floor F are cured by repetition of these just described steps. In an alternate embodiment electric ballast system 601 may have rollers enabling electric ballast system 601 to be rolled over floor F. Electric power cord 603 may be plugged into an extension cord long enough to enable electric ballast system 601 to be connected to a source of electricity while being rolled over floor F. In an alternate embodiment, electric power cord 603 may be of sufficient length to be connected directly to a source of electricity and enable electric ballast system 601 to be relocated over floor F as just described.

What is claimed is:

1. An apparatus for applying and concurrently curing a coating on a surface comprising:

a motor rotating a shaft at a first speed and having an outer casing, the rotating shaft operatively coupled to a rotating pad having a UV curable coating dispenser being connected to a supply of coating fluid for application to the surface that is curable upon exposure to UV light;

a handle connected to the motor for controlling movement of the apparatus along the surface causing the dispenser to establish a path for coating fluid on the substrate;

a radially outward rotating member operatively coupled to the outer casing of the motor for rotation at a second speed slower than the first speed; and at least one UV source generating a beam of UV light connected to the radially outward rotating member for rotation, with the beam directed to intersect the path of the coating fluid thereby curing the coating.

2. The apparatus of claim 1 wherein the number of UV sources supported for rotation is two.

3. The apparatus of claim 1 wherein the number of UV sources supported for rotation is four.

4. The apparatus of claim 1 wherein said UV source is a mercury vapor lamp tube.

5. The apparatus of claim 1 wherein said UV source is a string of light emitting diodes.

6. The apparatus of claim 1 further comprising an electrical ballast means for offsetting negative impedance of the UV source, the ballast means disposed in a box connected by a cable to the motor of said apparatus.

7. The apparatus of claim 1 wherein the motor is mounted in a housing that may be moved over the surface to be treated with said curable coating.

8. The apparatus of claim 7 wherein said housing is moved over a surface by a dispensing pad supported by the housing.

9. The apparatus of claim 7 wherein said housing is moved over a surface by wheels attached to the housing.

10. The apparatus of claim 1 wherein said beam of UV light has an intensity of several hundred watts per centimeter at said surface thereby instantly curing said curable coating.

* * * * *